US011749930B2

(12) United States Patent
Lee et al.

(10) Patent No.: US 11,749,930 B2
(45) Date of Patent: Sep. 5, 2023

(54) JOINT CONNECTER HAVING AN ISOLATION TERMINAL AND CONNECTION TERMINAL

(71) Applicants: Hyundai Motor Company, Seoul (KR); Kia Corporation, Seoul (KR); Yura Corporation Co., Ltd., Seongnam-si (KR)

(72) Inventors: Joon Ho Lee, Hwaseong-si (KR); Kwang Ho Song, Gunpo-si (KR); Young Bum Pi, Suwon-si (KR)

(73) Assignees: Hyundai Motor Company, Seoul (KR); Kia Corporation, Seoul (KR); Yura Corporation Co., Ltd., Seongnam-si (KR)

( * ) Notice: Subject to any disclaimer, the term of this patent is extended or adjusted under 35 U.S.C. 154(b) by 40 days.

(21) Appl. No.: 17/319,612

(22) Filed: May 13, 2021

(65) Prior Publication Data

US 2022/0077620 A1 Mar. 10, 2022

(30) Foreign Application Priority Data

Sep. 7, 2020 (KR) ..... 10-2020-0113515

(51) Int. Cl.

| | |
|---|---|
| ***H01R 13/436*** | (2006.01) |
| ***H01R 12/58*** | (2011.01) |
| ***H01R 13/502*** | (2006.01) |
| ***H01R 31/08*** | (2006.01) |

(52) U.S. Cl.

CPC ..... *H01R 13/4361* (2013.01); *H01R 12/58* (2013.01); *H01R 13/502* (2013.01); *H01R 31/085* (2013.01)

(58) Field of Classification Search

CPC .. H01R 13/4361; H01R 12/58; H01R 13/502; H01R 31/085; H01R 13/18; H01R 13/24; H01R 29/00; H01R 13/443; H01R 2201/26; H01R 13/46; H01R 13/02; H01R 13/40; H01R 13/422; H01R 13/428; H01R 13/506; H01R 13/639

See application file for complete search history.

(56) References Cited

U.S. PATENT DOCUMENTS

| | | | | |
|---|---|---|---|---|
| 10,651,604 | B2 * | 5/2020 | Tsukamoto | H01R 31/08 |
| 11,228,152 | B2 * | 1/2022 | Miyamura | H01R 31/06 |
| 2005/0101163 | A1 * | 5/2005 | Obikane | H01R 13/6471 439/74 |
| 2015/0002759 | A1 * | 1/2015 | Nakano | G06F 3/0412 349/12 |

(Continued)

FOREIGN PATENT DOCUMENTS

| | | | |
|---|---|---|---|
| KR | 101734656 | B1 | 5/2017 |

*Primary Examiner* — Abdullah A Riyami
*Assistant Examiner* — Nader J Alhawamdeh
(74) *Attorney, Agent, or Firm* — Slater Matsil, LLP

(57) ABSTRACT

A joint connector includes a housing comprising a plurality of insertion holes. A first isolation terminal is inserted into a first insertion hole of the plurality of insertion holes. The first isolation terminal is configured to block current flow. A connection terminal is inserted into a second insertion hole of the plurality of insertion holes. The second insertion hole is adjacent to the first insertion hole and is electrically connected to the first isolation terminal.

20 Claims, 14 Drawing Sheets

(56) References Cited

U.S. PATENT DOCUMENTS

| | | | | |
|---|---|---|---|---|
| 2015/0056830 | A1* | 2/2015 | Takaki | H01R 12/91 439/148 |
| 2016/0380377 | A1* | 12/2016 | Park | H01R 13/4361 439/695 |
| 2017/0250504 | A1* | 8/2017 | Bang | H01R 11/09 |
| 2019/0109416 | A1* | 4/2019 | Tsukamoto | H01R 13/6585 |
| 2022/0077620 | A1* | 3/2022 | Lee | H01R 13/443 |

* cited by examiner

JOINT CONNECTER HAVING AN ISOLATION TERMINAL AND CONNECTION TERMINAL

CROSS-REFERENCE TO RELATED APPLICATIONS

This application claims the benefit of Korean Patent Application No. 10-2020-0113515, filed on Sep. 7, 2020, which application is hereby incorporated herein by reference.

TECHNICAL FIELD

The present disclosure relates to a joint connector.

BACKGROUND

In general, a wiring harness, which is an assembly of electric cables or wires for performing operations, such as ignition, lighting, charging, etc., in a vehicle, is disposed throughout the entirety of the vehicle, from head lamps disposed at the front end portion of the vehicle to rear lamps disposed at the rear end portion of the vehicle, with a battery as the center. The circuit components of the vehicle wiring harness include power/signal inputs and ground/signal outputs, and there are the same circuit components.

Connecting the same circuit components, i.e., power and ground, display lamps, communication signals or the like, in the wiring harness, a joint connector is used to simplify circuit and path configurations by reducing the number of circuits.

FIGS. 1A to 1G illustrate a process of assembling a joint connector 1. The joint connector 1 includes a cap 3, short bars 5, a casing 7, terminals 9 and a retainer 11. The short bars 5 electrically connect the same circuit components or patterns and, in order to prevent generation of a short with different circuit components and moisture inflow, the short bars 5 are placed in the cap 3, as seen in FIGS. 1A and 1B. Wires W are connected to the respective terminals 9 so that the terminals 9 are connected to external circuits, and the respective terminals 9 are inserted into a plurality of compartments provided in the casing 7, as depicted in FIGS. 1C and 1D. The retainer 11 is coupled to the casing 7 to fix the terminals 9 inserted into the casing 7, as in FIG. 1E. When the cap 3 including the short bars 5 is mounted on the casing 7, the assembly of the joint connector 1 is completed, as illustrated in FIGS. 1F and 1G.

In the joint connector 1, if different patterns are required depending on specifications, short bars having different shapes need to be applied and caps having different shapes need to be applied in some cases. Then use of materials increases and a series of additional processes are required.

The above information disclosed in this Background section is only for enhancement of understanding of the background of the invention and therefore it may contain information that does not form the prior art that is already known to a person of ordinary skill in the art.

Korean Patent Registration No. 10-1734656 (Published on May 2, 2017) describes information related to the present subject matter.

SUMMARY

Embodiments of the present disclosure can solve problems associated with the prior art.

The present disclosure relates to a joint connector. Particular embodiments relate to a joint connector where circuit patterns are variously constructed in a simple manner.

An embodiment of the present invention provides a joint connector which does not require change or replacement of short bars or a cap depending on different patterns, thereby achieving cost reduction.

Another embodiment of the present invention provides a joint connector which does not require change or replacement of short bars or a cap depending on different patterns, thereby achieving weight reduction.

Still another embodiment of the present invention provides a joint connector which enables various patterns to be constructed in a simple manner.

Yet another embodiment of the present invention provides a joint connector which enables various patterns to be constructed while being prepared through a simple process.

Still yet another embodiment of the present invention provides a joint connector which obviates a cap and short bars.

One embodiment of the present invention provides a joint connector, comprising a housing comprising a plurality of insertion holes, at least one first isolation terminal inserted into a first insertion hole among the insertion holes, and at least one connection terminal inserted into a second insertion hole adjacent to the first insertion hole and electrically connected to the at least one first isolation terminal, wherein the first isolation terminal is configured to block current flow to the outside.

Other aspects and preferred embodiments of the invention are discussed infra.

Figure 1A:
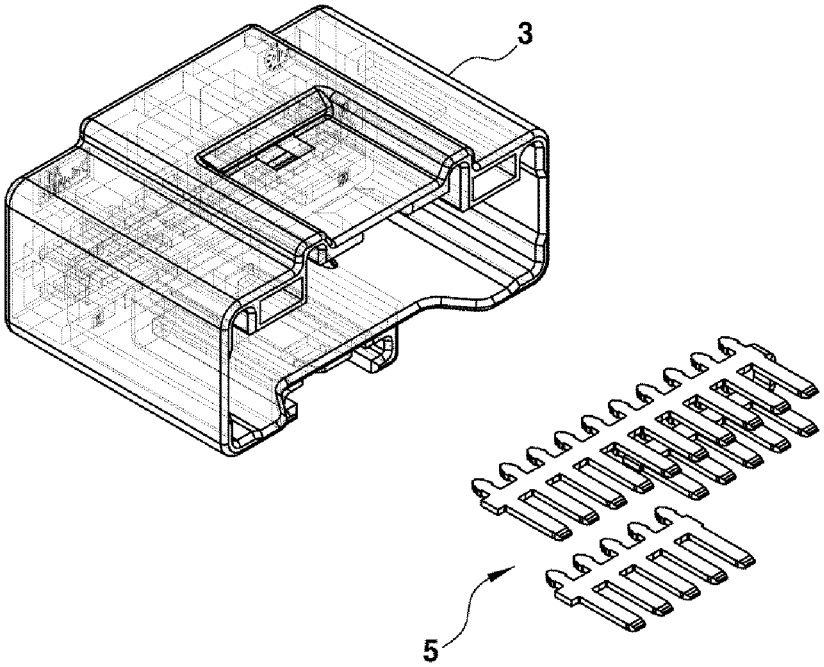
FIGS. 1A to 1G are perspective views illustrating a process of assembling a joint connector.
Figure 1B:
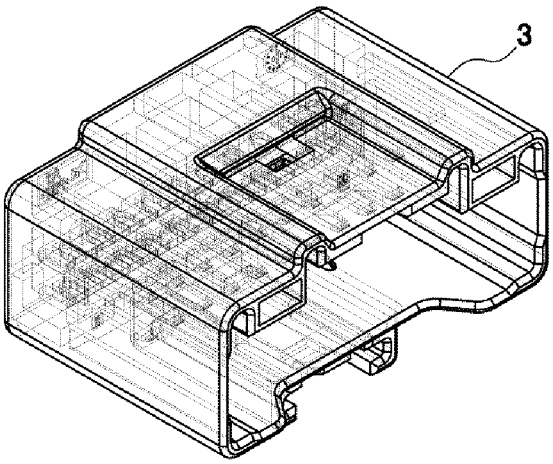

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF ILLUSTRATIVE EMBODIMENTS

Hereinafter, preferred embodiments of the present disclosure will be described in detail with reference to the accompanying drawings. Specific structures or functions described in the embodiments of the present disclosure are merely for illustrative purposes. Embodiments according to the concept of the present disclosure may be implemented in various forms, and it should be understood that they should not be construed as being limited to the embodiments described in the present specification, but include all of modifications, equivalents, or substitutes included in the spirit and scope of the present disclosure.

It will be understood that, although the terms "first," "second," etc. may be used herein to describe various elements, these elements should not be limited by these terms. These terms are only used to distinguish one element from another element. For instance, a first element discussed below could be termed a second element without departing from the teachings of the present invention. Similarly, the second element could also be termed the first element.

It will be understood that when an element is referred to as being "coupled" or "connected" to another element, it can be directly coupled or connected to the other element or intervening elements may be present therebetween. In contrast, it should be understood that when an element is referred to as being "directly coupled" or "directly connected" to another element, there are no intervening elements present. Other expressions that explain the relationship between elements, such as "between," "directly between," "adjacent to," or "directly adjacent to," should be construed in the same way.

Like reference numerals denote like components throughout the specification. In the meantime, the terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprise," "include," "have," etc., when used in this specification, specify the presence of stated components, steps, operations, and/or elements, but do not preclude the presence or addition of one or more other components, steps, operations, and/or elements thereof.

Hereinafter, embodiments of the present disclosure will be described in detail with reference to the accompanying drawings.

Figure 2:
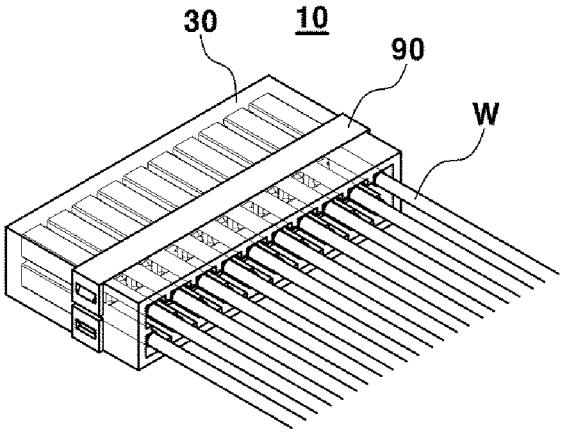
FIG. 2 is a perspective view illustrating a joint connector according to one embodiment of the present invention.

As shown in FIG. 2, a joint connector 10 according to embodiments of the present invention includes a housing 30, isolation terminals 50, connection terminals 70 and retainers 90.

Figure 3A:
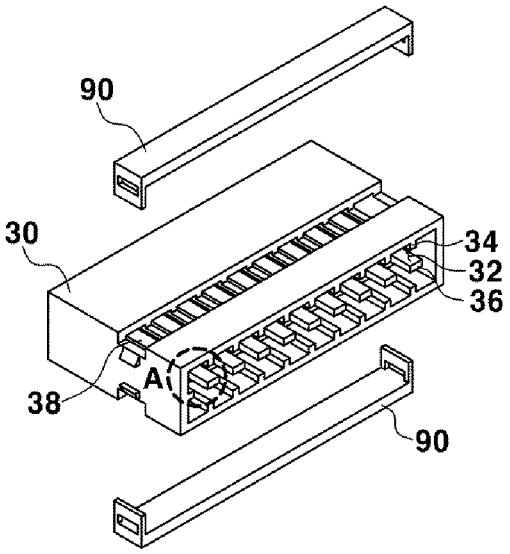
FIG. 3A is a perspective view illustrating a housing of the joint connector according to one embodiment of the present invention.
Figure 3B:
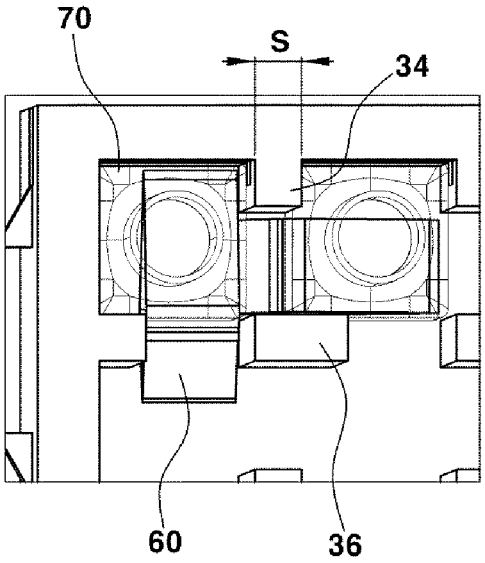
FIG. 3B is an enlarged view of portion A of FIG. 3A.

Referring to FIGS. 3A and 3B, a plurality of insertion holes 32 is arranged in the housing 30. Each insertion hole 32 is a divided space into which either an isolation terminal 50 or a connection terminal 70 is inserted. According to an embodiment of the present invention, the housing 30 is an injection molded product formed of plastic.

In the housing, the respective insertion holes 32 are separated from each other by a plurality of partition walls 34 and a plurality of supports 36. The partition walls 34 and the supports 36 are disposed between the respective insertion holes 32. According to an embodiment of the present invention, the partition walls 34 are spaced a certain distance apart from each other along the inner circumference of the housing 30 and protrude from the inner surface of the housing 30. According to an embodiment of the present invention, the supports 36 are disposed a certain distance apart from each other along the inner centerline of the housing 30.

The partition walls 34 and the supports 36 are provided to guide insertion of the isolation terminal 50 or the connection terminal 70 into the insertion holes 32. Also, the partition walls 34 and the supports 36 prevent interference between two terminals inserted in adjoining insertion holes 32. In more detail, a gap S is arranged between the adjoining insertion holes 32 by the partition walls 34 and/or the supports 36. Therefore, the partition walls 34 and the supports 36 may restrict the direction of the terminals 50 and 70 and prevent a short between different components.

The housing 30 may have mounting grooves 38. The mounting grooves 38 are depressed in the outer surface of the housing 30. Particularly, the mounting grooves 38 may be provided along the circumference of the housing 30.

Figure 4:
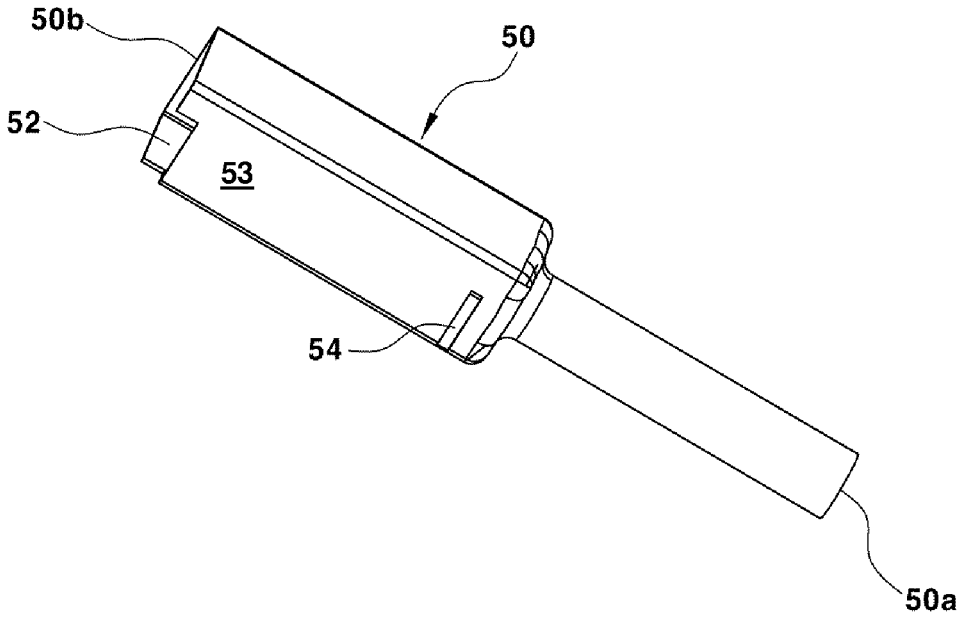
FIG. 4 is a perspective view illustrating an isolation terminal of the joint connector according to one embodiment of the present invention.

As shown in FIG. 4, the isolation terminal 50 aims to isolate circuits from each other. The isolation terminal 50 may receive current but does not have a structure for passing the current to another terminal, and thus, the isolation terminal 50 is used at the end of a pattern for separating circuits. According to an embodiment of the present invention, the isolation terminal 50 is formed of metal.

Figure 1C:
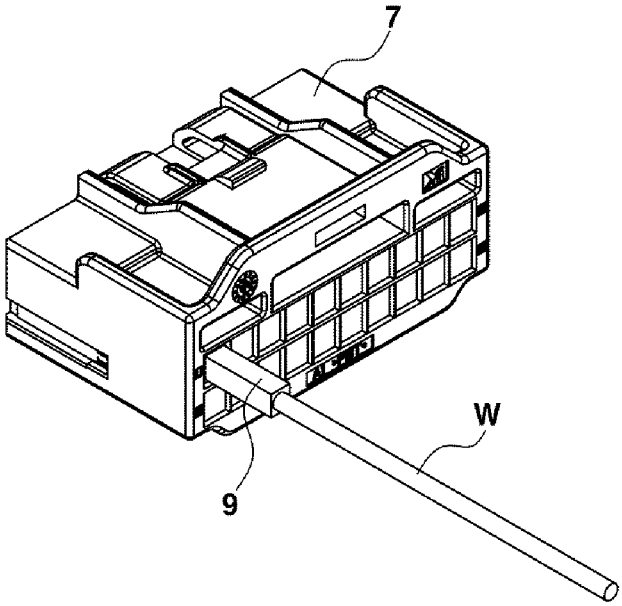
Figure 1D:
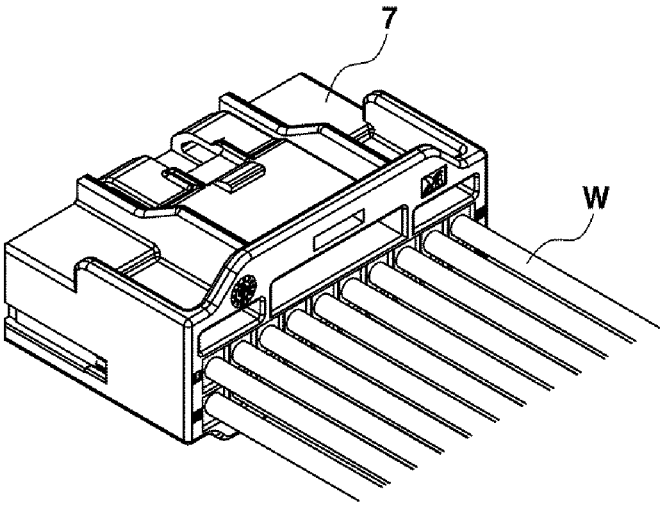
Figure 1E:
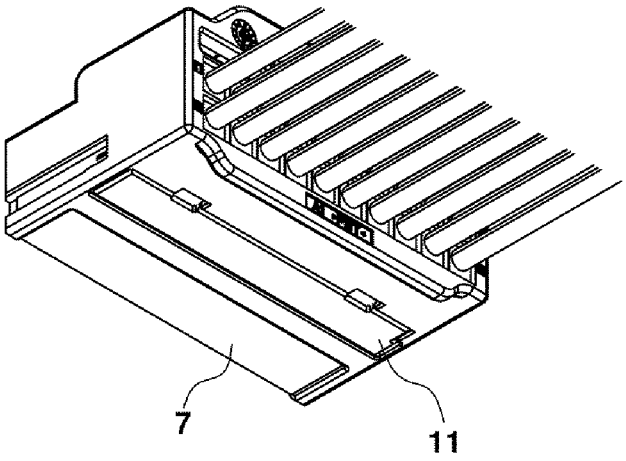
Figure 1F:
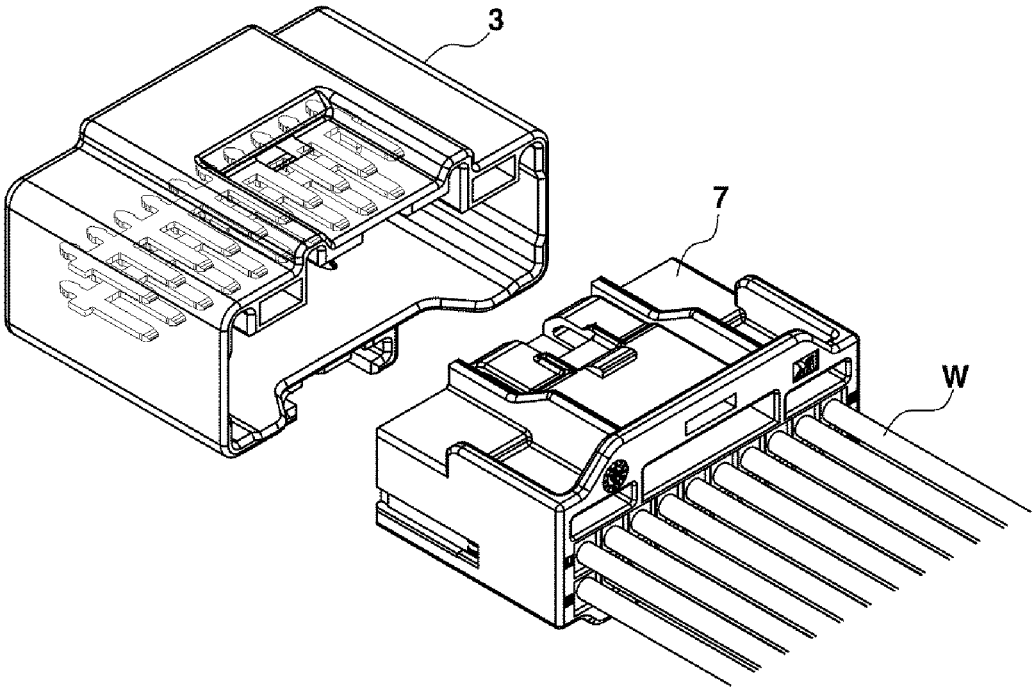
Figure 1G:
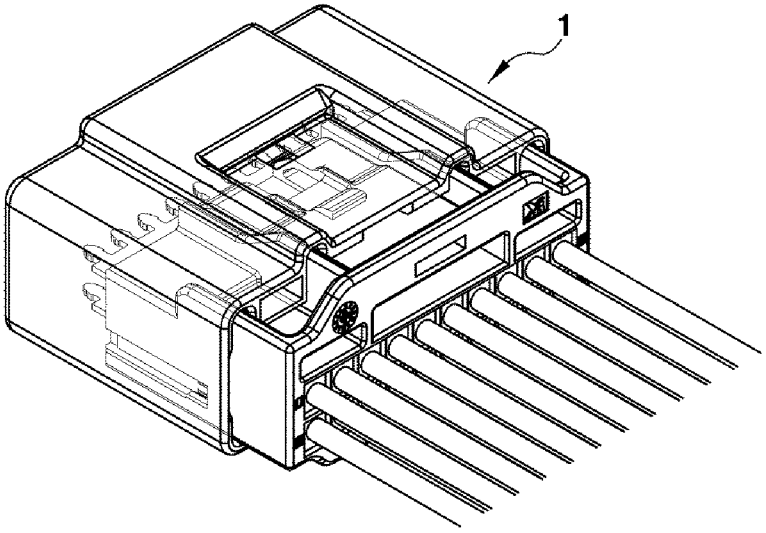

The isolation terminal 50 includes a connection portion 50*a* arranged at one end of the isolation terminal 50 and a wire W (see FIG. 1C) is connected to the connection portion 50*a*. In the instant embodiment, the other end of the isolation terminal 50 distant from the connection portion 50*a* will be referred to as a distal end sob.

According to an embodiment of the present invention, a non-conductive portion 53 of the isolation terminal 50 includes a cutout portion 52 and an insertion portion 54.

The cutout portion 52 is prepared by cutting out a part of the periphery of the non-conductive portion 53 at the distal end sob of the isolation terminal 50. As will be described below, in order to construct the connection terminal 70, a leaf spring 60 may be coupled to the cutout portion 52.

The insertion portion 54 may be spaced apart from the cutout portion 52 by a certain distance. Specifically, the insertion portion 54 is arranged at a position spaced a certain distance apart from the cutout portion 52 in the axial direction of the isolation terminal 50.

The insertion portion 54 pierces the non-conductive portion 53 of the isolation terminal 50 such that the inside and the outside of the isolation terminal 50 communicate with each other through the insertion portion 54. In order to construct the connection terminal 70, one side of the leaf spring 60 may be inserted into the insertion portion 54, thereby fixing the leaf spring 60 to the isolation terminal 50.

Figure 5A:
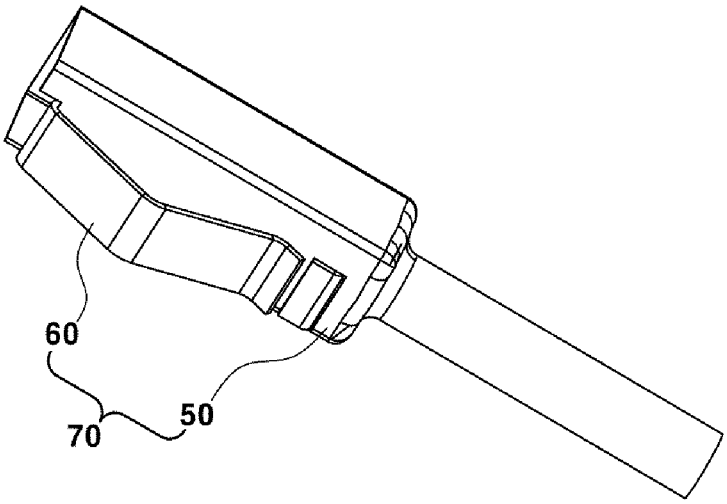
FIG. 5A is a perspective view illustrating a connection terminal of the joint connector according to one embodiment of the present invention.
Figure 5B:
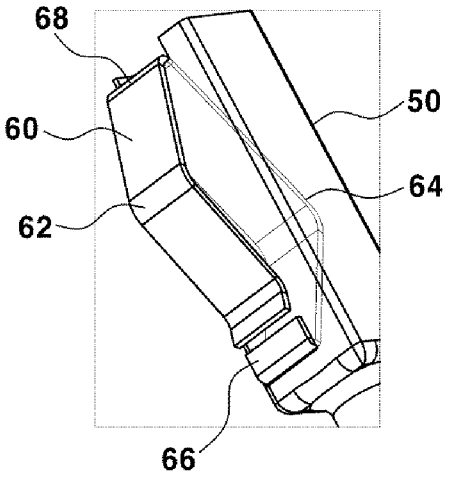
FIG. 5B is a partial perspective view of FIG. 5A.

Referring to FIGS. 5A and 5B, the connection terminal 70 includes the isolation terminal 50 and the leaf spring 60. That is, the connection terminal 70 is obtained by coupling the leaf spring 60 to the isolation terminal 50. The connection terminal 70 includes the leaf spring 60 for passing the current to either an isolation terminal 50 or a connection terminal 70, thereby connecting the same circuit components of the two terminals.

The leaf spring 60 may be formed of a metal having elasticity, and particularly be formed by bending a metal plate. According to an embodiment of the present invention, the leaf spring 60 may have at least three bending points.

The three bending points include an outer bending portion 62, an inner bending portion 64 and an engagement portion 66.

According to an embodiment of the present invention, some part of the leaf spring 60 is inserted into the isolation terminal 50, and the other portion of the leaf spring 60 is disposed outside the isolation terminal 50. The outer bending portion 62 bends outwards from the isolation terminal 50 to be spaced from the isolation terminal 50 and is positioned outside the isolation terminal 50. The inner bending portion 64 is inserted into the isolation terminal 50, bends inside the isolation terminal 50 in the opposite direction with respect to the bending direction of the outer bending portion 62 and contacts the inner wall of the isolation terminal 50. The leaf spring 60 may have a nearly rhomboidal shape when the leaf spring 60 is mounted on the isolation terminal 50, due to the outer bending portion 62 and the inner bending portion 64 which bend in opposite directions.

Further, the leaf spring 60 bends at the engagement portion 66. The end of the leaf spring 60 extending from the inner bending portion 64 bends and becomes the engagement portion 66. The engagement portion 66 is inserted into the insertion portion 54, thus providing fixing force of the leaf spring 60 to the isolation terminal 50.

The leaf spring 60 may further include a seat portion 68 which is seated on the cutout portion 52. The seat portion 68 of the leaf spring 60 is received in the cutout portion 52, so lateral movement of the leaf spring 60 can be prevented and the leaf spring 60 can be firmly secured with respect to the isolation terminal 50.

The seat portion 68 may be present between the outer bending portion 62 and the inner bending portion 64. The outer bending portion 62 and the inner bending portion 64 extend in the opposite directions from the seat portion 68 and bend in the opposite directions from each other. The outer bending portion 62 extends from the seat portion 68 towards the outside of the isolation terminal 50 at a first angle, bends with a second angle, and then extends, in which the first angle and the second angle may be different. The extending end of the outer bending portion 62 contacts the outer surface of the isolation terminal 50. The inner bending portion 64 extends from the seat portion 68 towards the inside of the isolation terminal 50 with a third angle. Thereafter, the inner bending portion 64 bends to have a fourth angle and then extends, and the inner bending portion 64 changes the direction thereof while bending and contacts the inner wall of the isolation terminal 50. The end of the inner bending portion 64 bends at a fifth angle, thus forming the engagement portion 66. Here, the third to fifth angles may be different values.

The retainers 90 are coupled to the periphery of the housing 30 in order to fix the connection terminals 70 and the isolation terminals 50 after insertion of the connection terminals 70 and the isolation terminals 50 into the housing 30. According to an embodiment of the present invention, the retainers 90 are arranged to have a shape corresponding to the shape of the mounting grooves 38 to be received in the mounting grooves 38. According to one embodiment of the present invention, the retainers 90 are formed by injection molding using plastic.

According to embodiments of the present invention, the leaf springs 60 may replace the conventional short bars and, thus, not only the short bars but also the cap may be omitted. Therefore, reduction in costs and weight may be achieved and the amount of labor required to assemble the joint connector 10 may be greatly reduced.

Figure 6A:
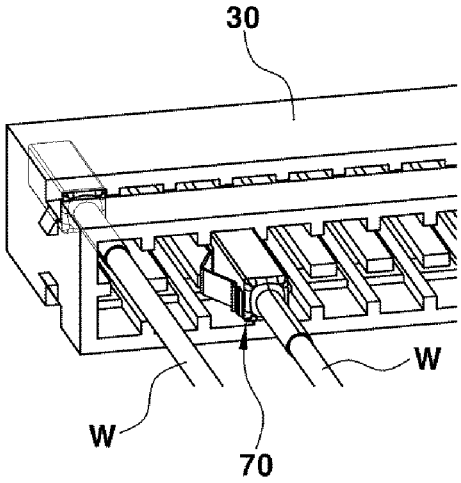
FIGS. 6A to 6C are views illustrating a circuit connection process in the joint connector according to one embodiment of the present invention.
Figure 6B:
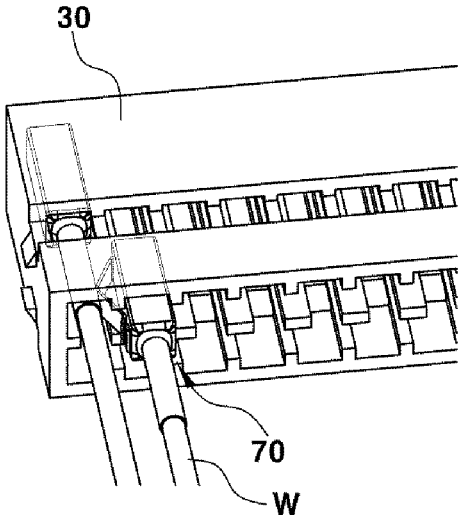
Figure 6C:
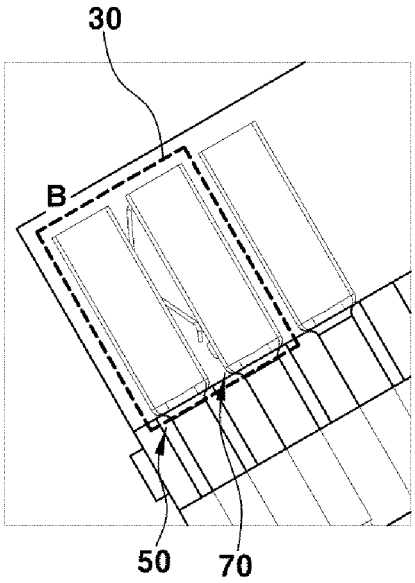

FIGS. 6A to 6C are views illustrating a circuit connection process in the joint connector according to an embodiment of the present invention. First, the connection terminal 70 is disposed such that the leaf spring 60 thereof faces a terminal to which the connection terminal 70 will be connected. When the connection terminal 70 is inserted into the insertion hole 32, the two terminals are electrically connected, as represented by box B in FIG. 6C.

Figure 7A:
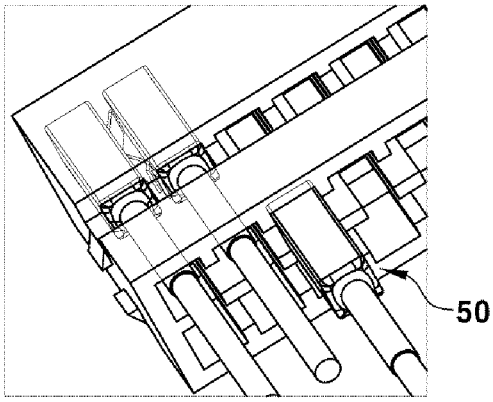
FIGS. 7A and 7B are views illustrating a circuit isolation process in the joint connector according to one embodiment of the present invention.
Figure 7B:
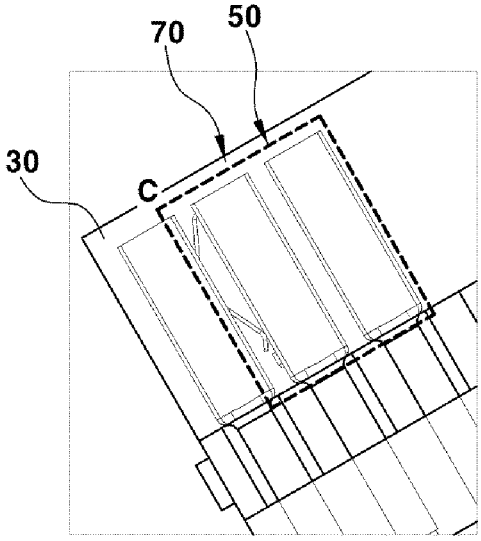

FIGS. 7A and 7B are views illustrating a circuit isolation process in the joint connector according to an embodiment of the present invention. When the isolation terminal 50 is inserted into the insertion hole 32 where the circuit will be separated, the two terminals become electrically isolated, as shown by box C of FIG. 7B.

Figure 8:
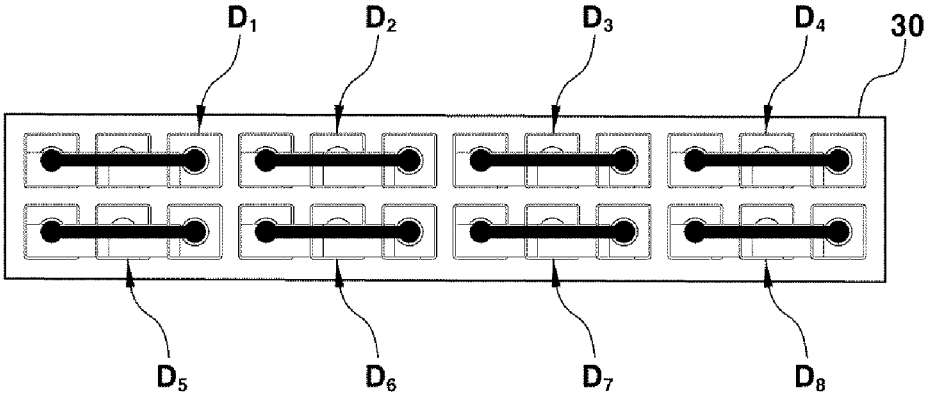
FIG. 8 is a view illustrating an exemplary pattern of the joint connector according to one embodiment of the present invention.

As shown in FIG. 8, according to embodiments of the present invention, a 3-pin circuit configuration may be provided. Conventionally, if the short bars are excessively small, the joint connector is difficult to handle. In this case, a circuit configuration having at least 4 pins were used. In contrast, according to embodiments of the present invention, a circuit configuration having 3 pins as the minimum same circuit component pattern is achievable. Thus, one connector can have a larger number of patterns. For example, in case of a conventional 24-pin connector, six 4-pin patterns could be prepared. According to embodiments of the present invention, eight 3-pin patterns D1 to D8 may be constructed, and one or two patterns may be added depending on the number of pins in the joint connector.

Figure 9A:
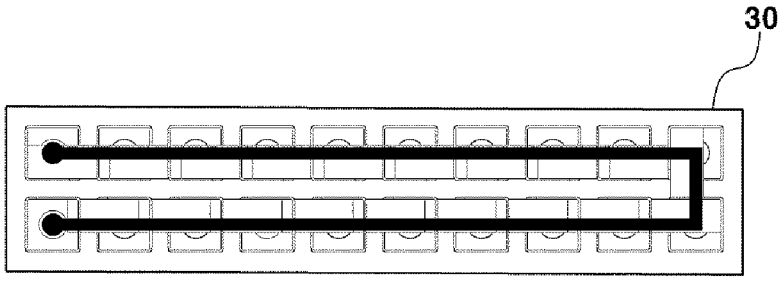
FIGS. 9A to 9C are views illustrating other exemplary patterns of the joint connector according to embodiments of the present invention.
Figure 9B:
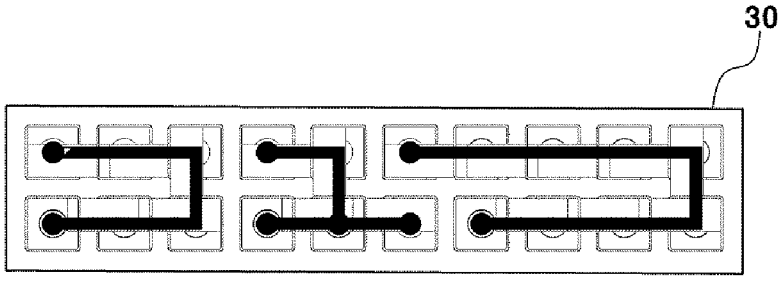
Figure 9C:
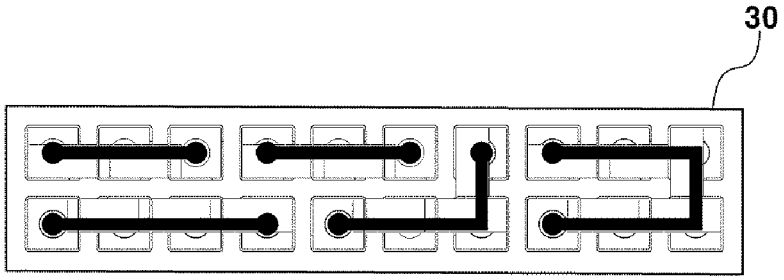

FIGS. 9A to 9C illustrate that various pattern configurations can be realized by changing the directions of the leaf springs 60 and using the isolation terminals 50 according to embodiments of the present invention. According to embodiments of the present invention, combinations of various patterns are possible in one housing 30 merely by changing the insertion directions of the leaf springs 60, and patterns are easily isolated merely by inserting the isolation terminals 50 into the housing 30.

Figure 10A:
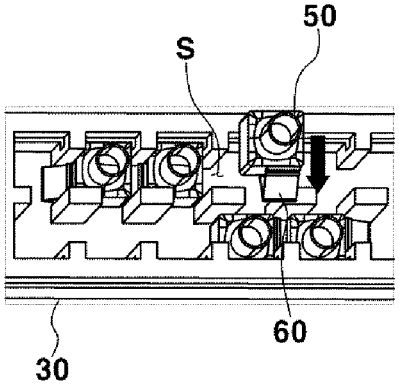
FIGS. 10A-10B, 11A-11B, and 12A-12B are views illustrating various pattern configurations of the joint connector according to embodiments of the present invention.
Figure 10B:
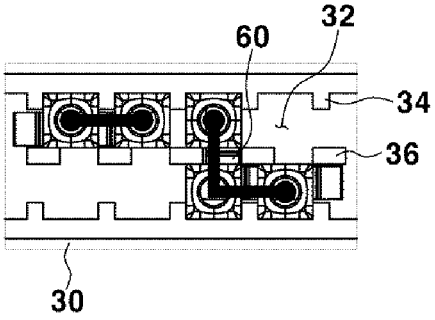

As shown in FIGS. 10A and 10B, when one connection terminal 70 is inserted into the insertion hole 32 such that the leaf spring 60 thereof faces downwards, the connection terminal 70 is electrically connected to a connection terminal 70 or an isolation terminal 50 located thereunder.

Figure 11A:
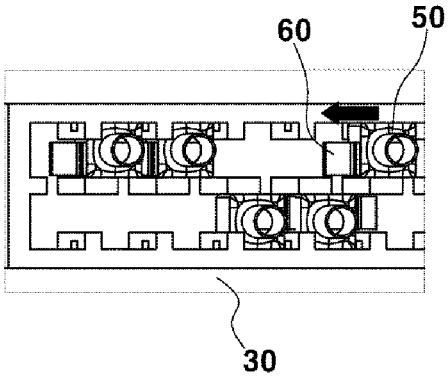
Figure 11B:
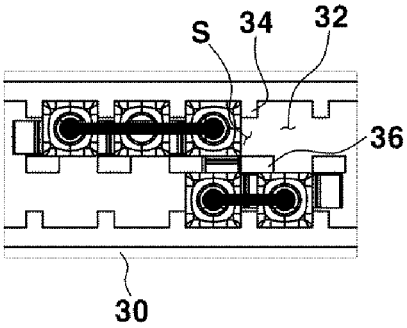

Alternatively, as shown in FIGS. 11A and 11B, when one connection terminal 70 is inserted into the same insertion hole 32 as in FIGS. 10A and 10B such that the leaf spring 60 thereof faces leftwards, the connection terminal 70 is electrically connected to a connection terminal 70 or an isolation terminal 50 located on the left thereof.

Figure 12A:
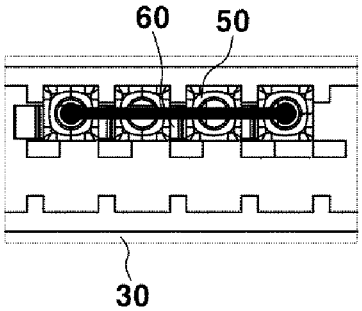
Figure 12B:
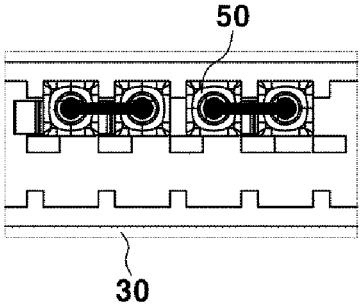

FIG. 12A illustrates that four connection terminals 70 are conductively connected. In this state, when the third connection terminal 70 from the left is replaced with an isolation terminal 50, the two connection terminals 70 from the left may be connected to each other, the two connection terminals 70 from the right may be connected to each other, but the second terminal from the left and the third terminal from the left are isolated from each other, separating circuits, as shown in FIG. 12B.

As such, the joint connector according to embodiments of the present invention enables free and easy configuration of patterns.

The conventional joint connector requires the short bars for electrical connection and the cap for preventing the short bars from being exposed to the outside, thereby requiring an additional process of installing materials and increasing costs and/or weight. In contrast, the joint connector according to embodiments of the present invention does not require the short bars and the caps of the conventional joint connector, which reduces costs, weight and labor.

In general, a joint connector fundamentally requires one short bar. More short bars are needed for each circuit component when several circuit components, such as for power and ground, display lamps, and communication signals, are configured. However, it becomes increasingly difficult to add more short bars due to small size requirements for connectors and it is disadvantageous to use different connectors for each pattern. The joint connector according to embodiments of the present invention enables construction of various patterns merely by varying the insertion directions of terminals, thus increasing work efficiency and enabling flexible response to design changes.

As is apparent from the above description, a joint connector according to embodiments of the present invention does not require short bars or a cap to be changed or replaced for different patterns, thereby achieving cost reduction.

Further, the joint connector according to embodiments of the present invention, which does not require the short bars or the cap to be changed or replaced for different patterns, may achieve weight reduction.

In addition, the joint connector according to embodiments of the present invention enables various patterns to be implemented in a simple manner.

Further, the joint connector according to embodiments of the present invention enables various patterns to be implemented while being manufactured through a simple process.

Moreover, the joint connector according to embodiments of the present invention does not require the cap and the short bars which are used in the conventional joint connector.

It should be understood that the present disclosure is not limited to the above described embodiments and the accompanying drawings, and various substitutions, modifications, and alterations can be devised by those skilled in the art without departing from the technical spirit of the present disclosure.

What is claimed is:

1. A joint connector comprising:

a housing comprising a plurality of insertion holes;

a first isolation terminal inserted into a first insertion hole of the plurality of insertion holes, wherein the first isolation terminal is configured to block current flow; and a connection terminal inserted into a second insertion hole of the plurality of insertion holes, the second insertion hole being adjacent to the first insertion hole and the connection terminal being electrically connected to the first isolation terminal, wherein the first isolation terminal is configured to receive the current flow from the connection terminal but not to transfer the current flow to the connection terminal.

2. The joint connector of claim 1, wherein the connection terminal comprises:

a second isolation terminal having a shape identical to that of a shape of the first isolation terminal; and a leaf spring coupled to the second isolation terminal and being electrically connectable.

3. The joint connector of claim 2, wherein:

a first portion of the leaf spring is inserted into the second isolation terminal; and a second portion of the leaf spring is disposed outside the second isolation terminal.

4. The joint connector of claim 3, wherein:

a part of the first portion is configured to contact an inner wall of the second isolation terminal; and the second portion is bent to be spaced apart from the second isolation terminal.

5. The joint connector of claim 2, wherein:

a gap is disposed between the first insertion hole and the second insertion hole; and the leaf spring is configured to pass through the gap and to contact the first isolation terminal.

6. The joint connector of claim 2, wherein the second isolation terminal comprises:

a cutout portion provided at an end the second isolation terminal, a part of the end being cut out; and an insertion portion piercing the second isolation terminal and being spaced apart from the cutout portion.

7. The joint connector of claim 6, wherein the leaf spring comprises:

a seat portion bent to be received in the cutout portion; and an outer bending portion extending from the seat portion to a first length in a first direction with a first angle, and then bent at a second angle different from the first angle.

8. The joint connector of claim 7, wherein the leaf spring further comprises an inner bending portion extending from the seat portion in a second direction with a third angle, to extend towards an inside of the second isolation terminal, to bend at a fourth angle different from the third angle, and then to extend to a second length, wherein the inner bending portion comes into contact with an inner wall of the second isolation terminal while bending to the fourth angle from the third angle.

9. The joint connector of claim 8, wherein the leaf spring further comprises an engagement portion configured to bend from the inner bending portion at a predetermined angle so as to be inserted into the insertion portion.

10. The joint connector of claim 1, further comprising retainers mounted on a periphery of the housing.

11. The joint connector of claim 10, wherein:

the housing includes mounting grooves depressed from an outer surface of the housing in a circumferential direction of the housing; and the retainers are configured to be received in the mounting grooves.

12. The joint connector of claim 1, wherein the first isolation terminal comprises:

a cutout portion provided at an end of the first isolation terminal, a part of the end being cut out; and an insertion portion configured to pierce the first isolation terminal and being spaced a distance apart from the cutout portion.

13. The joint connector of claim 1, wherein the housing comprises a plurality of partition walls and a plurality of supports disposed between the insertion holes.

14. The joint connector of claim 13, wherein the partition walls protrude from an inner periphery of the housing by a distance.

15. The joint connector of claim 13, wherein the supports are spaced apart from each other by an interval along an inner centerline of the housing.

16. A joint connector comprising:

a housing including a plurality of insertion holes;

isolation terminals, wherein each of the isolation terminals is inserted into a respective one of the insertion holes, each isolation terminal being configured to block current flow; and connection terminals, wherein each of the connection terminals is inserted into a respective one of the insertion holes, each connection terminal comprising a modified isolation terminal that is configured to pass current flow;

wherein the isolation terminals and the connection terminals are interconnected in a predetermined circuit pattern so that current can flow between the connection terminals and be blocked by the isolation terminals; and wherein the isolation terminal is configured to receive the current flow from a first connection terminal adjacent thereto but not to transfer the current flow to a second connection terminal adjacent thereto.

17. The joint connector of claim 16, wherein each isolation terminal comprises:

a connection portion inserted in the respective one of the insertion holes;

a cutout portion formed in a non-conductive portion of the isolation terminal, the cutout portion adjacent a distal end of the isolation terminal; and an insertion portion formed in the non-conductive portion and spaced from the cutout portion.

18. The joint connector of claim 17, wherein each connection terminal comprises:

an isolation terminal; and a leaf spring having a first end inserted in the insertion portion and a second end attached at the cutout portion.

19. A method of forming a joint connector, the method comprising:

providing a plurality of isolation terminals;

converting ones of the isolation terminals into connection terminals; and inserting isolation terminals and connection terminals into insertion holes of a housing so that the isolation terminals and the connection terminals are interconnected in a predetermined circuit pattern so that current can flow between the connection terminals and be blocked by the isolation terminals, wherein the isolation terminal is configured to receive the current from a first connection terminal adjacent thereto but not to transfer the current to a second connection terminal adjacent thereto.

20. The method of claim 19, wherein converting ones of the isolation terminals into connection terminals comprises attaching a leaf spring to each isolation terminal that is converted into a connection terminal.

* * * * *